US009439459B2

(12) United States Patent
Placanica et al.

(10) Patent No.: US 9,439,459 B2
(45) Date of Patent: Sep. 13, 2016

(54) ATHLETIC SHIRT

(71) Applicants: Matteo Placanica, Piancogno (IT); Romina Scalvinoni, Costa Volpino (IT)

(72) Inventors: Matteo Placanica, Piancogno (IT); Romina Scalvinoni, Costa Volpino (IT)

( * ) Notice: Subject to any disclaimer, the term of this patent is extended or adjusted under 35 U.S.C. 154(b) by 0 days.

(21) Appl. No.: 14/432,561

(22) PCT Filed: Sep. 27, 2013

(86) PCT No.: PCT/IB2013/058939
§ 371 (c)(1),
(2) Date: Mar. 31, 2015

(87) PCT Pub. No.: WO2014/053976
PCT Pub. Date: Apr. 10, 2014

(65) Prior Publication Data

US 2015/0237926 A1 Aug. 27, 2015

(30) Foreign Application Priority Data

Oct. 4, 2012 (IT) ..... BS2012A0143

(51) Int. Cl.
*A63B 21/02* (2006.01)
*A41D 13/00* (2006.01)
*A63B 69/00* (2006.01)

(52) U.S. Cl.
CPC ..... *A41D 13/0015* (2013.01); *A41D 13/0007* (2013.01); *A41D 2600/10* (2013.01)

(58) Field of Classification Search
CPC ..... A42B 1/12; A41G 5/0093; A61K 8/24; A61Q 17/04; A63B 2208/12; A63B 31/08; A63B 33/00; Y10S 2/909
See application file for complete search history.

(56) References Cited

U.S. PATENT DOCUMENTS 2,568,304 A * 9/1951 Schoenbrun ..... A47D 13/086 119/770
4,222,388 A * 9/1980 Brown ..... A41C 3/144 2/65
4,273,216 A * 6/1981 Weissmann ..... A62B 35/0006 182/3
4,325,378 A * 4/1982 Wilkinson ..... A41C 3/02 450/58
4,698,847 A * 10/1987 Yoshihara ..... A41B 9/08 2/406
4,781,651 A * 11/1988 Ekins ..... A41C 3/0057 450/25
4,862,523 A * 9/1989 Lipov ..... A41B 11/14 2/409
4,910,802 A * 3/1990 Malloy ..... A41D 13/0015 2/227
4,953,856 A * 9/1990 Fox, III ..... A63B 21/065 2/69
5,046,194 A * 9/1991 Alaniz ..... A41D 13/0015 2/69

(Continued)

*Primary Examiner* — Bobby Muromoto, Jr.
(74) *Attorney, Agent, or Firm* — Volpe and Koenig, PC

(57) ABSTRACT

An athletic shirt includes at least one chest portion adapted to dress the user chest. The chest portion has a front face dressing the user torso and a rear face, opposite to the front face, which dresses the back of the user. The front face of the chest portion has an upper portion which covers the pectoral muscles of the user and a lower portion which covers the user's abdomen. The chest portion comprises adherence means for adhering the upper portion to the pectoral muscles of the user so that to limit or completely avoid the rubbing of the upper portion itself against the user's nipples. The adherence means includes an elastic portion.

10 Claims, 4 Drawing Sheets

(56) References Cited

U.S. PATENT DOCUMENTS 5,201,074 A * 4/1993 Dicker ..... A41D 13/0015 2/227
5,282,277 A * 2/1994 Onozawa ..... A41D 13/00 2/108
5,367,708 A * 11/1994 Fujimoto ..... A41D 13/0015 2/22
5,577,306 A * 11/1996 Gold ..... A41F 1/06 24/300
5,765,224 A * 6/1998 Johnson ..... A41C 1/02 2/44
5,829,058 A * 11/1998 Dicker ..... A41D 13/0015 2/227
5,857,947 A * 1/1999 Dicker ..... A63B 21/4025 2/69.5
5,857,990 A * 1/1999 Maas ..... A61F 5/3746 602/20
5,867,827 A * 2/1999 Wilkinson ..... A41D 13/0015 2/115
5,937,442 A * 8/1999 Yamaguchi ..... A41D 13/00 2/115
5,960,474 A * 10/1999 Dicker ..... A41D 13/0015 2/227
6,068,538 A * 5/2000 Alleyne ..... A41C 3/02 450/1
6,176,816 B1 * 1/2001 Dicker ..... A63B 21/4025 2/69.5
6,231,488 B1 * 5/2001 Dicker ..... A41D 13/0015 2/69
6,374,418 B1 * 4/2002 Rindle ..... A42B 1/048 2/202
6,440,094 B1 * 8/2002 Maas ..... A61F 5/3738 2/44
6,892,396 B2 * 5/2005 Uno ..... A41D 13/0015 2/115
7,087,032 B1 * 8/2006 Ikeda ..... A61F 5/03 128/891
7,089,597 B2 * 8/2006 Horii ..... A41B 9/06 2/106
D539,512 S * 4/2007 Ota ..... D2/844
7,241,252 B1 * 7/2007 Gagliardi ..... A41B 9/001 2/2.5
7,871,388 B2 * 1/2011 Brown ..... A61F 5/026 602/19
7,908,670 B2 * 3/2011 Semba ..... A41D 1/04 2/115
8,007,457 B2 * 8/2011 Taylor ..... A61F 5/0102 2/69
8,167,490 B2 * 5/2012 Hu ..... B31D 1/0056 383/75
8,506,350 B1 * 8/2013 Silverman ..... A41C 3/00 450/67
8,887,315 B2 * 11/2014 Boynton ..... A61F 5/026 2/24
8,910,317 B2 * 12/2014 Decker ..... A41D 13/0002 2/227
9,009,863 B2 * 4/2015 Decker ..... A41B 1/08 2/44
9,314,363 B2 * 4/2016 Ingimundarson ..... A61F 5/0102
2002/0062510 A1 * 5/2002 Mullen ..... A41D 13/0007 2/69
2002/0078485 A1 * 6/2002 Ferreiro ..... A41D 1/04 2/69
2003/0028952 A1 * 2/2003 Fujii ..... A41C 1/003 2/400
2004/0133959 A1 * 7/2004 Horii ..... A41B 9/06 2/69
2005/0177920 A1 * 8/2005 Wilkinson ..... A41D 13/0525 2/69
2006/0000478 A1 * 1/2006 Taylor ..... A61F 5/0102 128/869
2006/0089083 A1 * 4/2006 Tonsor ..... A41C 3/02 450/60
2006/0101553 A1 * 5/2006 Aspray ..... A41D 13/015 2/69
2007/0271671 A1 * 11/2007 Okajima ..... A41D 1/04 2/69
2007/0281586 A1 12/2007 Pritchard
2008/0076645 A1 * 3/2008 Brown ..... A63B 21/0552 482/124
2008/0208089 A1 * 8/2008 Newkirk ..... A61F 5/026 602/19
2008/0287036 A1 * 11/2008 McGuire ..... A41C 3/02 450/23
2009/0062704 A1 * 3/2009 Brown ..... A61F 5/026 602/19
2009/0075561 A1 3/2009 Doellefeld
2010/0077527 A1 * 4/2010 Lee ..... A41D 13/0015 2/69
2010/0122403 A1 * 5/2010 Mickle ..... A41D 13/0518 2/461
2010/0272379 A1 * 10/2010 Hu ..... B31D 1/0056 383/75
2010/0275346 A1 * 11/2010 Delonas ..... A41B 9/001 2/400
2011/0092134 A1 * 4/2011 Alva ..... A41C 3/04 450/36
2011/0237995 A1 * 9/2011 Ota ..... A41D 13/0015 602/75
2011/0302686 A1 12/2011 Chapuis
2012/0084903 A1 * 4/2012 Roberts ..... A41B 9/02 2/400
2012/0150085 A1 * 6/2012 Kayser ..... A61F 5/026 602/19
2012/0260404 A1 * 10/2012 Steele ..... A41B 9/023 2/404
2012/0324618 A1 * 12/2012 Dieffenbacher ..... A41D 1/067 2/93
2013/0053750 A1 * 2/2013 Taylor ..... A61F 13/06 602/75
2013/0115852 A1 * 5/2013 Blackwell ..... A41C 3/0064 450/58
2013/0167285 A1 * 7/2013 Decker ..... A41D 13/0002 2/69
2013/0298306 A1 * 11/2013 Turner ..... A41D 1/08 2/115
2014/0143929 A1 * 5/2014 Curran ..... A41D 27/14 2/69
2014/0289939 A1 * 10/2014 Omer ..... A63B 71/12 2/463
2014/0302748 A1 * 10/2014 Blackwell ..... A41C 3/0064 450/58
2014/0317826 A1 * 10/2014 Decker ..... A41B 1/08 2/69
2015/0094634 A1 * 4/2015 Waeger ..... A61F 5/026 602/19

* cited by examiner

ATHLETIC SHIRT

SCOPE OF THE INVENTION

The present invention relates to the field of sportswear and, in particular, relates to a man T-shirt for the practice of running or equivalent sports. With the term "running", the practice of track events in general, running or jogging is meant.

The present invention claims the priority of the Italian patent application BS2012A000143 filed on Oct. 4, 2012.

STATE OF THE ART

As known, T-shirts used in the running practice exhibit certain manufacturing characteristics mainly related to the fabrics with which they are realized and to the design thereof, which has to assure a comfortable wearability.

In particular, such T-shirts are made in a breathable fabric able to provide the athlete with an optimal comfort while running. The breathable fabric, generally a synthetic fiber, ensures that the body moisture goes through the T-shirt without being retained, thus reducing the sweat condensation and increasing the garment comfort.

A further manufacturing aspect is the design, that is to say the shape, of the T-shirt which has to be soft, that is not too much form-fitted to the user chest, to assure an ease of movement and avoid discomforts in addition to promote the breathability.

In particular, the T-shirts for the practice of track events are realized by assembling two portions one to another, a front portion dressing the user torso and a rear portion dressing the back of the same; the assembly is obtained with the so called "flat" seams which avoid irritations on contact with the user skin. Portions made in different materials can be further provided, such as for example portions of a mesh disposed in side regions which promote a greater ventilation.

A drawback of the above described T-shirts is mainly related to the characteristics themselves of the breathable fabric of synthetic fiber and to the shape, that is to say the cut, thereof.

The rubbing of the sweat-soaked T-shirt fabric against sensitive body regions, in particular the nipples, is found to cause skin irritations and rashes; the assiduous runners are even often subjected to bleeding phenomena of the portions subjected to rubbing against the T-shirt, in particular they are subjected to bleeding of the nipples. This is due to the fact that during the running the T-shirt moves and does not remain close-fitted to the user chest.

The known sport T-shirts do not solve the afore said technical problem.

For example, in US 2009/075561 a T-shirt for the sport practice is described which comprises a front portion and a rear portion coupled one to another with a covering portion interposed therebetween which screens the user nipples from view. The cover portion is substantially a piece of fabric arranged at the chest, but which in its turn rubs against the user skin and against the nipples thereof.

There are woman sport T-shirts comprising a band for supporting and containing the breast. Such a T-shirt is described in US 2007/281586. The support band is substantially configured as a bra embedded in the T-shirt fabric to encircle the breast and avoid the excessive breast movement bothering the athlete during running. For obvious reasons this technical solution is not applied to man T-shirts.

In US 2011/302686 a garment for the sport practice is described, mainly realized in fabric and comprising one or more compressing portions. In particular, the compressing portions provide an elastic layer coupled to the fabric provided with a plurality of openings, for example an elastic net. The compressing portions exert a compression force in certain regions of the wearer body, for example the pectoral or the quads, such to create a postural support for the user.

Therefore, this document also refers to garments realized in order to provide a support and/or to improve the postural position of a user during the sport practice.

SUMMARY OF THE INVENTION

It is an object of the present invention to provide a man T-shirt for running which solves the drawbacks of the known T-shirts.

It is an object of the present invention also to provide a man T-shirt for running which is comfortable, simple and cost effective to realize.

These and other objects are obtained by a man T-shirt for running according to claim 1.

In particular, the T-shirt comprises at least one chest portion adapted to be worn on the user chest. The chest portion has a front face dressing the user torso and a rear face, opposite to the front face, dressing the torso or back of the user.

The front face of the chest portion comprises in its turn an upper portion intended for covering the pectoral muscles of the user and a lower portion adjoining the upper portion, to dress the user abdomen.

Means are further provided for adhering, by simply holding the contact, the upper portion to the pectoral muscles of the user at least at the nipples so that to limit or avoid the rubbing thereof against the user nipples.

In particular, the adherence means exert a compression force comprised between 3 mmHg and 25 mmHg, in particular between 5 mmHg and 10 mmHg (mercury millimeters, according to the scale commonly used to measure the strains in the fabric stripes). It is a compression force notably lower than, and not comparable with, the compression force exerted by the compression portions described in US 2011/302686.

The above defined range of compression force is adapted to make the upper portion of the T-shirt keep a contact adequate to make the T-shirt not move with respect to the body, and at the same time such to not exert any contraction at the pectoral muscles of the user.

Preferably, the above means comprise an elastic portion coupled at the upper portion of the T-shirt; the elastic portion allows urging the upper portion to adhere to user pectorals.

Alternatively, the adherence means comprise at least one elastic seam connecting different pieces or portions of fabric one to another which assembled compose the upper portion of the T-shirt.

Yet alternatively, the adherence means comprise a portion of fabric, preferably a stripe, whose weaving differs by typology and/or number of stitches from the weaving of the T-shirt chest portion; the fabric portion with different weaving is characterized by having a greater elasticity with respect to the other portions of the T-shirt.

In other words, the seam, the elastic portion or the different weaving portion have substantially the effect of causing the T-shirt to adhere to the runner pectorals. The percent elongation and therefore the elasticity degree in each of the above described solutions is preferably comprised between 20% and 70%.

The object is to limit or completely prevent the rubbing of the upper portion against sensitive regions of the skin, in particular the nipples.

In a preferred embodiment a first and a second elastic portions are provided which extend in parallel one to another along the upper portion from the shoulder of the user up to join to a third elastic portion disposed substantially at the pectoral muscles of the user. In this way, the elastic portions keep only the upper portion of the T-shirt close fitting to the pectoral muscles of the user, whereas they do not affect the adhesion of the lower portion dressing the abdomen, least of all the adhesion of the rear face of the T-shirt which dresses the back of the user, thus keeping a soft wearability which means comfort and ease of movement for the user.

Preferably, the third elastic portion is an annular portion which extends circumferentially between the front face and the rear face of the chest portion and is positioned substantially at or under the pectoral muscles.

Alternatively, the third elastic portion extends transversally only on the front face of the T-shirt and is laterally fixed preferably by a seam, on a side portion at the area of the user hips.

In an alternative embodiment, a first and a second elastic portions are provided which extend from the user shoulder crossed one to another at the upper portion. In particular, the first and the second elastic portions both extend obliquely from the shoulder towards an opposite side portion so that to define a cross centered on the upper portion of the chest portion. Preferably, the first and the second elastic portions join one to another in the rear face of the chest portion.

Again alternatively, the elastic portion is realized in shape of a band arranged at the upper portion of the T-shirt so that to place itself straddled the pectoral muscles and thus the nipples. In such a case as well, only the band extends at the front face of the T-shirt and is sewed on the side portions of the T-shirt. Alternatively, the band has annular shape and completely extends around the bust of the user.

In a preferred embodiment, each elastic portion comprises an elastic insert; each elastic insert is stitched from the inner side of the front face of the chest portion. The elastic inserts are preferably wire-like, band-like or ribbon-like inserts.

In a preferred embodiment each elastic insert is inserted into a housing pocket obtained on the inner side of the front face. The housing pocket is obtained by the aid of an additional portion of fabric superimposed from the inner side to the front face itself. In other words, the elastic inserts remain embedded in the T-shirt so that to not contact directly the skin of the user but to remain screened through the additional portion of fabric. Alternatively, the housing pocket of the elastic inserts can be obtained on the outer side as well.

In a preferred embodiment, at least one of the elastic inserts is provided with means for adjusting the length in order to adjust and adapt the adherence of the upper portion of the chest portion according to the different physical shapes of the user chest.

DESCRIPTION OF THE DRAWINGS

Further characteristics and advantages of the present invention will be more evident from a review of the following specification of a preferred, but not exclusive, embodiment, shown for illustration purposes only and without limitation, with the aid of the attached drawings, in which.

DETAILED DESCRIPTION OF THE INVENTION

Figures 1, 1A:
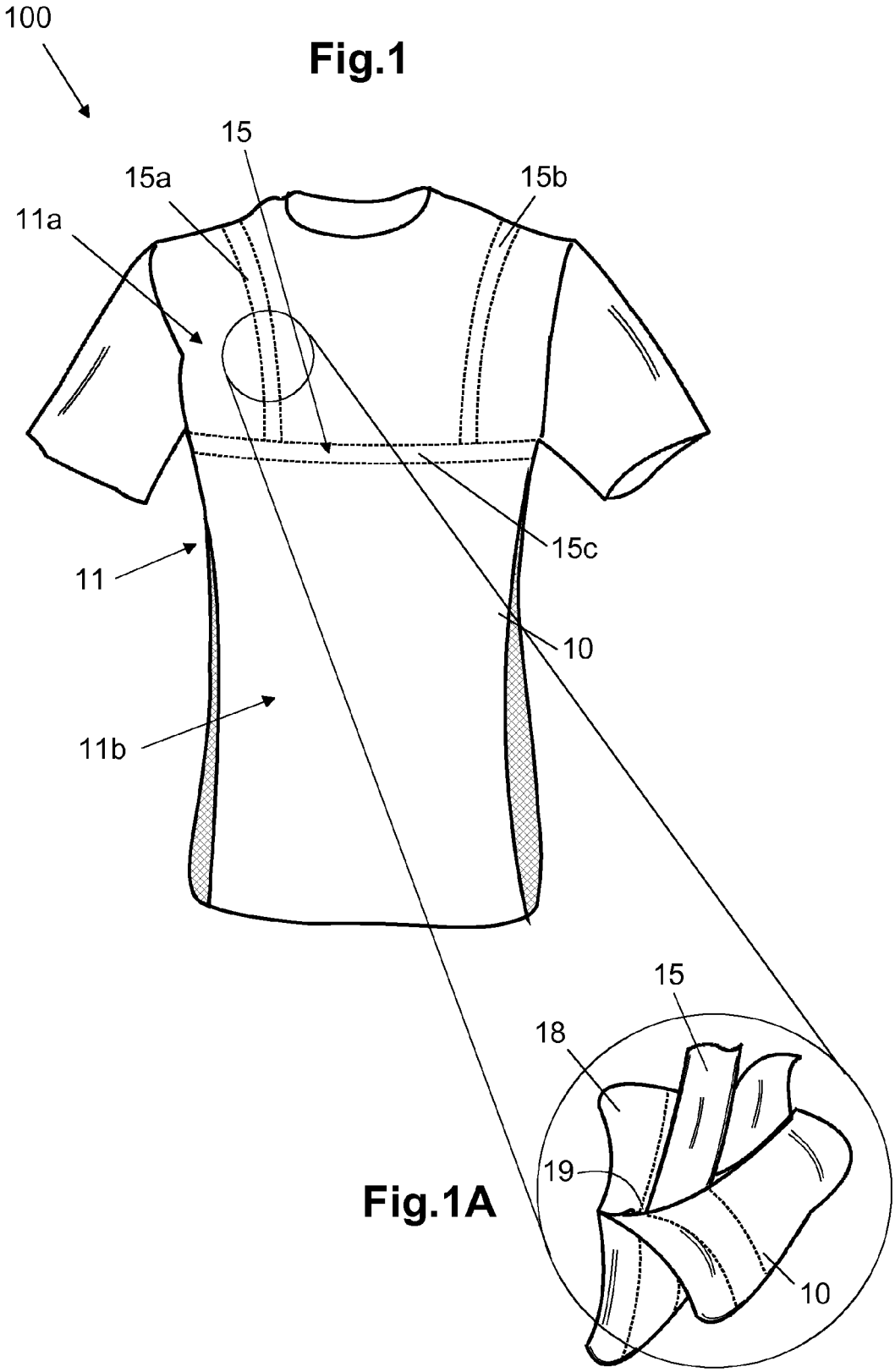
FIG. 1 shows a perspective front view of a sport T-shirt for the running practice.
FIG. 1A shows an enlarged view of a possible embodiment of elastic means inserted into the T-shirt.
Figure 2:
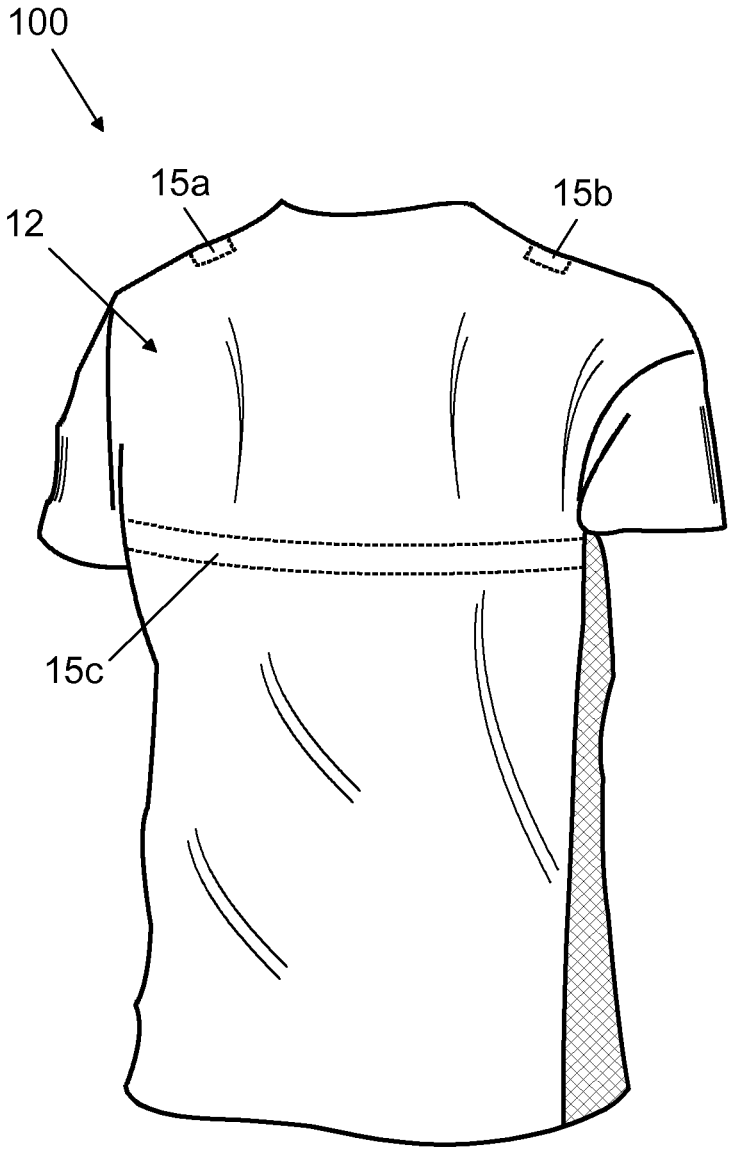
FIG. 2 shows a rear perspective view of the sport T-shirt for the running practice of FIG. 1.
Figure 3:
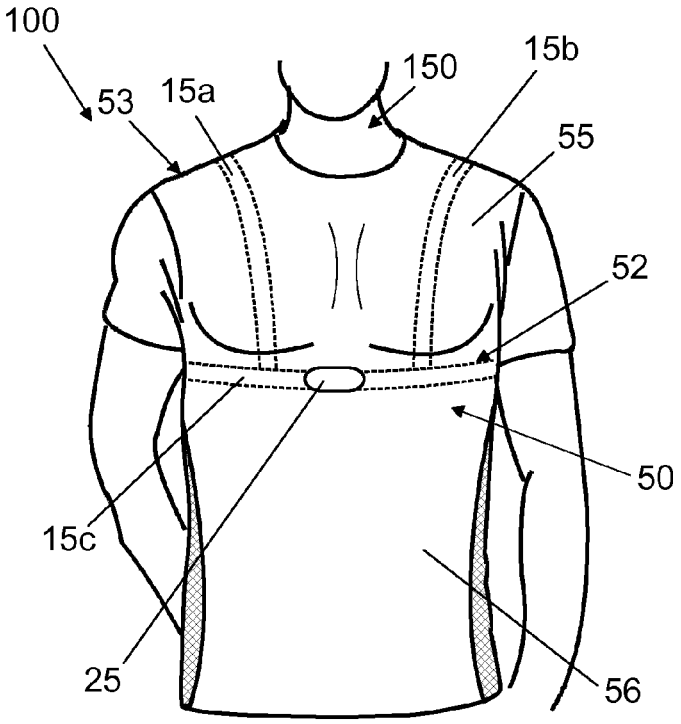
FIG. 3 shows a front perspective view of the T-shirt of FIGS. 1 and 2 worn by an user, according to a first embodiment.
Figure 3A:
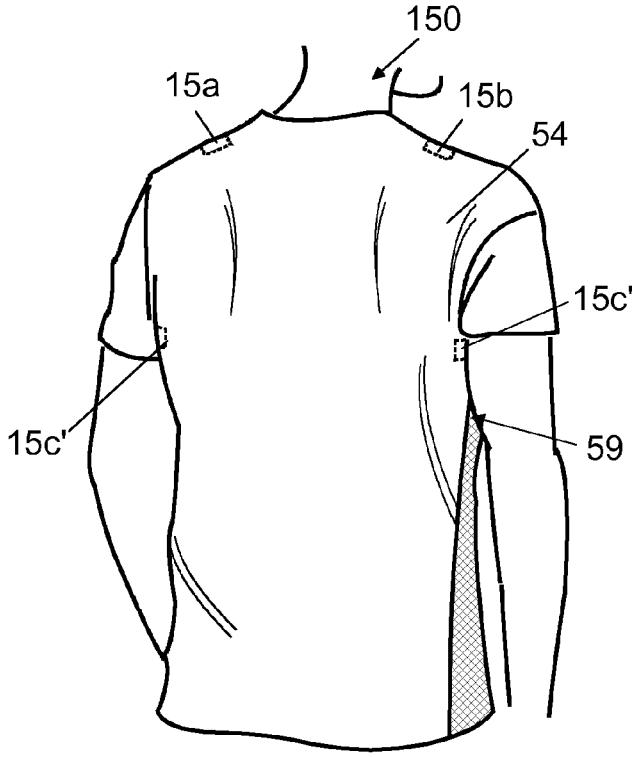
FIG. 3A shows a rear perspective view of the T-shirt of FIGS. 1 and 2 worn by the user.

Referring to FIGS. 1 and 2 a man running T-shirt 100 is shown, according to the present invention. In particular the T-shirt 100 comprises a chest portion 10 adapted to be worn on the chest 50 of the user 150 (FIGS. 3 and 3A). The chest portion 10 has a front face 11 intended to cover the torso 52 of the user (FIG. 3) and a rear face 12 opposite to the front face 11, intended to cover the back or torso 54 of the same (FIG. 3A). With chest portion 10 the portion is meant which covers the user chest. In an embodiment, such a chest portion can be provided with short sleeves, as depicted in the present figures, or else long sleeves, or yet it can be a singlet.

More in particular the front face 11 of the chest portion 10 is defined in its turn by an upper portion 11*a* which represents the portion substantially at the chest or pectoral muscles 55 of the user and by a lower portion 11*b* which dresses the abdomen 56 of the user 150, still as shown referring to FIGS. 3 and 3A.

The chest portion 10 and in particular the upper portion 11*a* comprises means 15 for adhering the upper portion 11*a* to the pectoral muscles 55 of the user 150, so that to limit or avoid the movement of the upper portion 11*a* of the T-shirt against the pectoral muscles 55 and in particular against the nipples. By limiting or avoiding such a movement the rubbing of the fabric itself of the T-shirt against sensitive parts of the skin is prevented, in particular the nipples thus aiding the comfort of assiduous user, which uses the T-shirt for an extended time.

In particular the adherence means determine a compression force on pectoral muscles to keep the T-shirt rested and to avoid the rubbing thereof against the nipples. In particular, the adherence means exert a compression force comprised between 3 mmHg and 25 mmHg, preferably between 5 mmHg and 10 mmHg.

In particular, as shown in figures, with adherence means different manufacturing solutions are intended which indiscriminately perform the same function.

In particular, in a first embodiment the aforesaid means comprise at least one elastic portion 15 coupled at the upper portion 11*a* of the T-shirt 10. The elastic portion 15, as described in detail later, allows keeping close fitted the upper portion 11*a* so that to avoid the rubbing of the fabric against the nipples.

Alternatively such adherence means comprise at least one seam 15 carried out in the fabric which connects at least two pieces of fabric one to another which combined compose the upper portion 11*a* of the T-shirt. Such a seam carried out for example by elastic filaments acts as an elastic element and allows obtaining in this case too an adherence of the only upper portion 11*a* to the pectorals 55 of the user.

Yet still alternatively, the adherence means comprise a portion of fabric 15, preferably in the form of a stripe or band, with a different weaving or weft, for example by typology and/or number of stitches, with respect to the weaving of the T-shirt itself. In this way, the portion of fabric with different weaving has a different elasticity degree which makes it flexible and elastically deformable.

It has to be specified that the adherence means 15 are represented and indicated in figures in the same way, thereby such a representation is meant to depict indiscriminately all the afore mentioned embodiments that is to say the elastic portion, the seam band or the textile portion with different weaving.

In all the embodiments, the upper portion 11*a* keeps adhering to the chest 55 of the user during the motion, avoiding a rubbing of the fabric on the sensitive parts in particular the nipples. In particular, the degree of elasticity defined as percent elongation for the afore said solutions is preferably comprised between 20% and 70%.

In addition, being the adherence of the T-shirt delimited at the only upper portion 11*a*, the chest portion 10 holds a comfortable wearability in the lower portion 11*b* of the front face 11 itself and on the rear face 12. With "comfortable wearability" is meant the chest portion 10 remaining soft in said regions thus aiding the user's easiness of movement and the breathability of the fabric itself.

In a preferred embodiment, as shown in FIGS. 1 and 2, a first 15*a* and a second 15*b* elastic portions are provided developing from the top of the scapula or shoulder 53 so that to result substantially straddled on the latter. The elastic portions 15*a*, 15*b* are substantially parallel one to another and develop longitudinally towards the lower portion 11*b* up to join to a third elastic portion 15*c*. In other words, the first 15*a* and the second 15*b* elastic portions compose a shoulder strap preferably anchored with stitches to the upper portion 11*a* of the front face 11.

In particular, as shown in FIG. 2, the elastic portions 15*a* and 15*b* in the rear face 12 are broken and do not join to the third elastic portion 15*c* as it happens in the front face 11. In fact the latter, as said afore, are fixed, preferably by a seam, at the scapula or shoulder 53 of the user. This allows holding a close fitting configuration of the chest portion 10 in the only front upper portion 11*a* and a softer wearability in the rear face 12 promoting the ventilation and the breathability of the fabric.

In fact, the elastic portions 15*a*, 15*b* and 15*c* do not act as supporting or containing elements but they perform the only function of rendering the upper portion 11*a* next to the chest 55 of the user 150.

Figure 4:
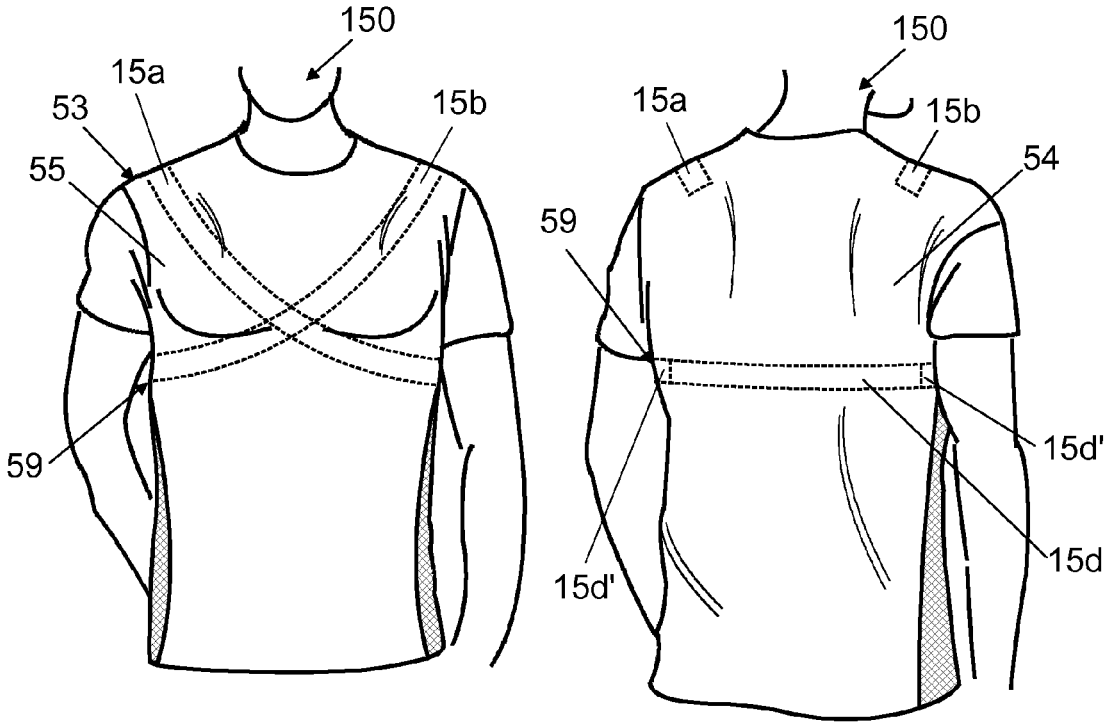
FIG. 4 shows a front and rear perspective view of a second embodiment of the sport T-shirt.

More in particular, the third portion 15*c* can have an annular shape so that to completely enclose the chest of the user 150 (FIG. 4). In such a case, the annular elastic portion 15*c* is arranged substantially under the chest 55 of the user.

Alternatively, as shown in FIG. 3A, the third portion 15*c*' extends only on the front face 11 of the T-shirt 10, always in the same position under the chest 55, and is fixed with stitches at the side portions 59 of the chest portion 10 of the T-shirt which are respectively at the hips area of the user 150.

In an alternative embodiment, shown in FIG. 4, the first 15*a* and the second 15*b* elastic portions are crossed one to another at the upper portion 11*a*. In such a case too each elastic portion 15*a*, 15*b* is fixed at the scapula 53 of the user straddling the shoulder 53 and extends obliquely towards the side portion 59 of the T-shirt always at the hips of the user 150. The two ends indicated by 15*d*' of the elastic portions 15*a*, 15*b* can then be sewed and fastened at the side portions 59 of the T-shirt substantially on the rear face 12 of the T-shirt. Such a solution is represented in FIG. 4 by a broken line which identifies the ends 15*d*' of the two elastic portions 15*a*, 15*b* in the broken arrangement.

Alternatively, the elastic portions 15*a*, 15*b* join in a single branch 15*d* in the rear face 12 of the chest portion 10.

Figure 5:
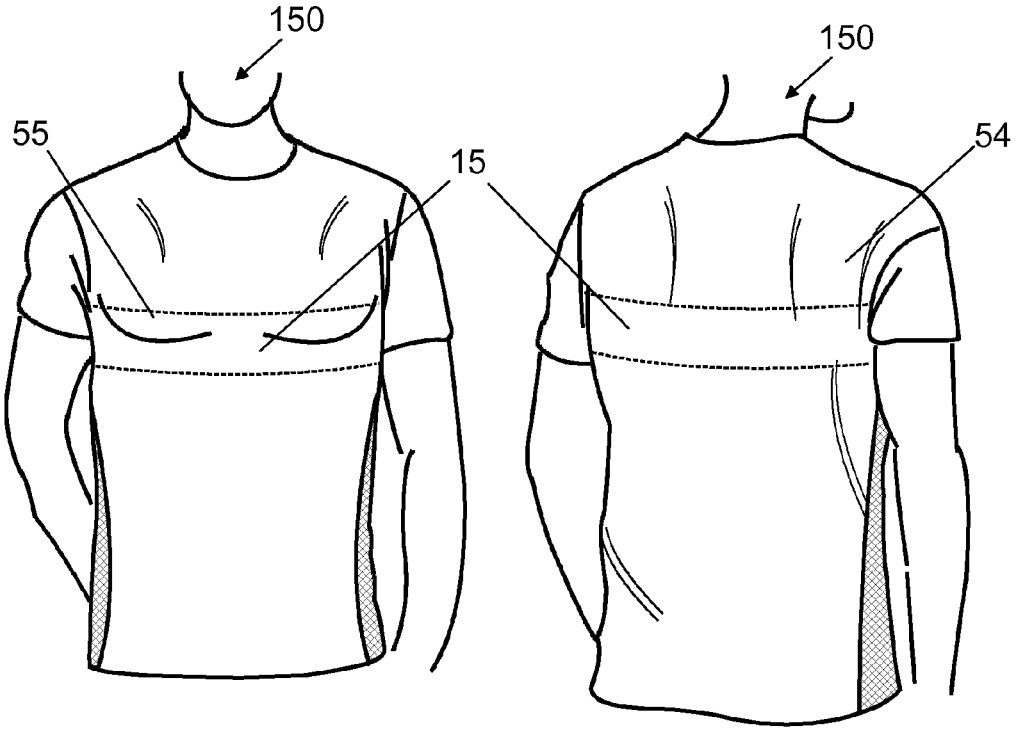
FIG. 5 shows a front and rear perspective view of a third embodiment of the sport T-shirt.

As shown in FIG. 5, in a further embodiment a single elastic portion 15 is provided in the form of a band with determined length which encloses the chest 55 at the nipples of the user. In this version too the band can be of annular type, as depicted, or else it can extend only on the front face 11 and be anchored at the side portions 59 of the T-shirt itself.

In the afore described embodiments, the elastic portions 15*a*, 15*b* and 15*c* comprise elastic inserts of wire- or ribbon-type stitched from the inner side of the front face 11 of the chest portion 10. In particular, as shown in FIG. 1A, each elastic insert 15 is inserted inside a housing pocket 19 obtained on the inner side of the front face 11. The housing pocket 19 is, for example, realized by the aid of an additional portion of fabric 18 superimposed from the inner side to the front face 11 itself. In this way the elastic inserts 15 remain embedded in the T-shirt so that to not contact the skin of the user 150 directly. Alternatively, the housing pocket 19 of the elastic inserts can be obtained from the outer side as well.

At least one of the elastic inserts 15 can further comprise means 25 for adjusting the length so that to adapt to the different physical shapes of the user 150. In particular, as shown in FIG. 3, means 25 for adjusting the annular elastic insert 15*c* which encloses the chest of the user, are provided.

The invention claimed is:

1. An athletic shirt (100) for sports comprising at least one chest portion (10) adapted to be fitted onto the chest (50) of an user (150), wherein the chest portion (10) has a front face (11) which dresses the user's torso (52) and a rear face (12), opposite the front face (11), which dresses a user's (150) back (54), wherein the front face (11) of the chest portion (10) comprises an upper portion (11*a*) which covers the user's pectoral muscles (55) and a lower portion (11*b*) adjacent to the upper portion (11*a*), which covers the user's (150) abdomen (56), further comprising adherence means adapted to hold said upper portion (11*a*) rested directly in contact with the pectoral muscles (55) of the user (150) at least at the user's nipples, so that to limit or avoid rubbing of the upper portion (11*a*) itself against nipples of the user (150) wherein said adherence means comprise an elastic portion (15) coupled at the upper portion (11*a*) of the shirt and;

further wherein a first (15*a*) and a second (15*b*) elastic portion are provided, which extend in parallel one to another along the upper portion (11*a*) from a user's (150) shoulder (53) up to join to a third elastic portion (15*c*) disposed substantially at the user's pectoral muscles (55).

2. The shirt (100) according to claim 1, wherein said adherence means exert a compression force between 3 mmHg and 25 mmHg.

3. The shirt (100) according to claim 1, wherein said adherence means comprise at least one elastic seam connecting different pieces of fabric one to another which compose said upper portion (11*a*) of the shirt.

4. The shirt (100) according to claim 1, wherein said adherence means comprise a textile portion whose weaving differs in typology and/or number of stitches from other textile portions composing said chest portion (10) of the shirt, said textile portion with different weaving has a greater elasticity with respect to the other shirt portions.

5. The shirt (1) according to claim 1, wherein said third elastic portion is selected from:

an annular portion (15*c*) extending circumferentially between the front face (11) and the rear face (12) of the chest portion (10) and being positioned substantially at the pectoral muscles (55); or an elastic portion (15*c*') extending transversally only on the front face (11) of the shirt and being fixed laterally at side portions (59) respectively covering the user's (150) sides.

6. An athletic shirt (100) for sports comprising at least one chest portion (10) adapted to be fitted onto the chest (50) of an user (150), wherein the chest portion (10) has a front face (11) which dresses the user's torso (52) and a rear face (12), opposite the front face (11), which dresses a user's (150) back (54), wherein the front face (11) of the chest portion (10) comprises an upper portion (11*a*) which covers the user's pectoral muscles (55) and a lower portion (lib) adjacent to the upper portion (11*a*), which covers the user's (150) abdomen (56);

wherein said adherence means comprise an elastic portion (15) coupled at the upper portion (11*a*) of the shirt and;

further comprising adherence means adapted to hold said upper portion (11*a*) rested directly in contact with the pectoral muscles (55) of the user (150) at least at the user's nipples, so that to limit or avoid rubbing of the upper portion (11*a*) itself against the nipples of the user (150), wherein a first (15*a*) and a second (15*b*) elastic portion are provided, both extending obliquely from the shoulder (53) of the user (150) towards an opposite side portion (59), crossing one another at the upper portion (11*a*) of the chest portion (10).

7. The shirt (100) according to claim 1, wherein an elastic band-like portion (15) is provided, disposed at the upper portion (11*a*) positioned on the pectoral muscles (55) of the user (150) at the user's nipples.

8. The shirt (100) according claim 1, wherein each elastic portion comprises an elastic insert (15, 15*a*, 15*b*, 15*c*) inserted inside a housing pocket (19) on an inner side of the front face (11) and stitched, the housing pocket (19) formed by an additional fabric portion (18) superimposed from the inner side to the same front side (11).

9. The shirt (100) according to claim 8, wherein at least one of said elastic inserts (15, 15*a*, 15*b*, 15*c*) comprises means (25) for adjusting length to adjust and adapt the adhesion of the upper portion (11*a*) of the chest portion (10) to different physical shapes of the user (150).

10. The shirt (100) according to claim 1, wherein said adherence means exert a compression force between 5 mmHg and 10 mmHg.

* * * * *